US005306453A

United States Patent [19]

Shulman

[11] Patent Number: 5,306,453

[45] Date of Patent: Apr. 26, 1994

[54] APPARATUS AND METHOD OF MAKING A NON-WOVEN FABRIC

[76] Inventor: Edward Shulman, R.D. #1, Box 205, Frenchtown, N.J. 08825

[21] Appl. No.: 109,334

[22] Filed: Aug. 18, 1993

[51] Int. Cl.[5] ..... B27N 3/04

[52] U.S. Cl. ..... 264/121; 264/518; 425/83.1

[58] Field of Search ..... 264/518, 121, 113; 425/83.1

[56] References Cited

U.S. PATENT DOCUMENTS

| | | | |
|---|---|---|---|
| 2,931,076 | 4/1960 | Clark | 425/83.1 |
| 4,212,602 | 7/1980 | Miller | 425/83.1 |
| 4,258,455 | 3/1981 | Werner | 425/83.1 |
| 4,264,289 | 4/1981 | Day | 425/83.1 |
| 4,278,113 | 7/1981 | Persson | 425/83.1 |
| 4,352,649 | 10/1982 | Jacobsen et al. | 425/83.1 |
| 4,375,447 | 3/1983 | Chung | 264/518 |
| 4,627,806 | 12/1986 | Johnson | 425/83.1 |
| 4,640,810 | 2/1987 | Laursen et al. | 264/518 |
| 4,732,552 | 3/1988 | Chung | 425/82.1 |
| 5,068,079 | 11/1991 | Gustafsson | 264/518 |

*Primary Examiner*—Mary Lynn Theisen
*Attorney, Agent, or Firm*—Sanford J. Piltch

[57] ABSTRACT

Apparatus and method for the forming of fiber structures or webs utilizing a rotor having a plurality of blade sets helically arranged about its periphery for detangling and declumping air-entrained fibers which are deposited against a sizing screen, said blades act to push individualized fibers, with the assistance of positive air pressure, through the screen into a free-fall zone for deposit on an underlying forming wire.

15 Claims, 5 Drawing Sheets 24a
24b
20
32
70
68
42d
42c
40d
40e
42h
42g
40c
42b
40b
48
42f
42a
40a
42e
22
38
72
44

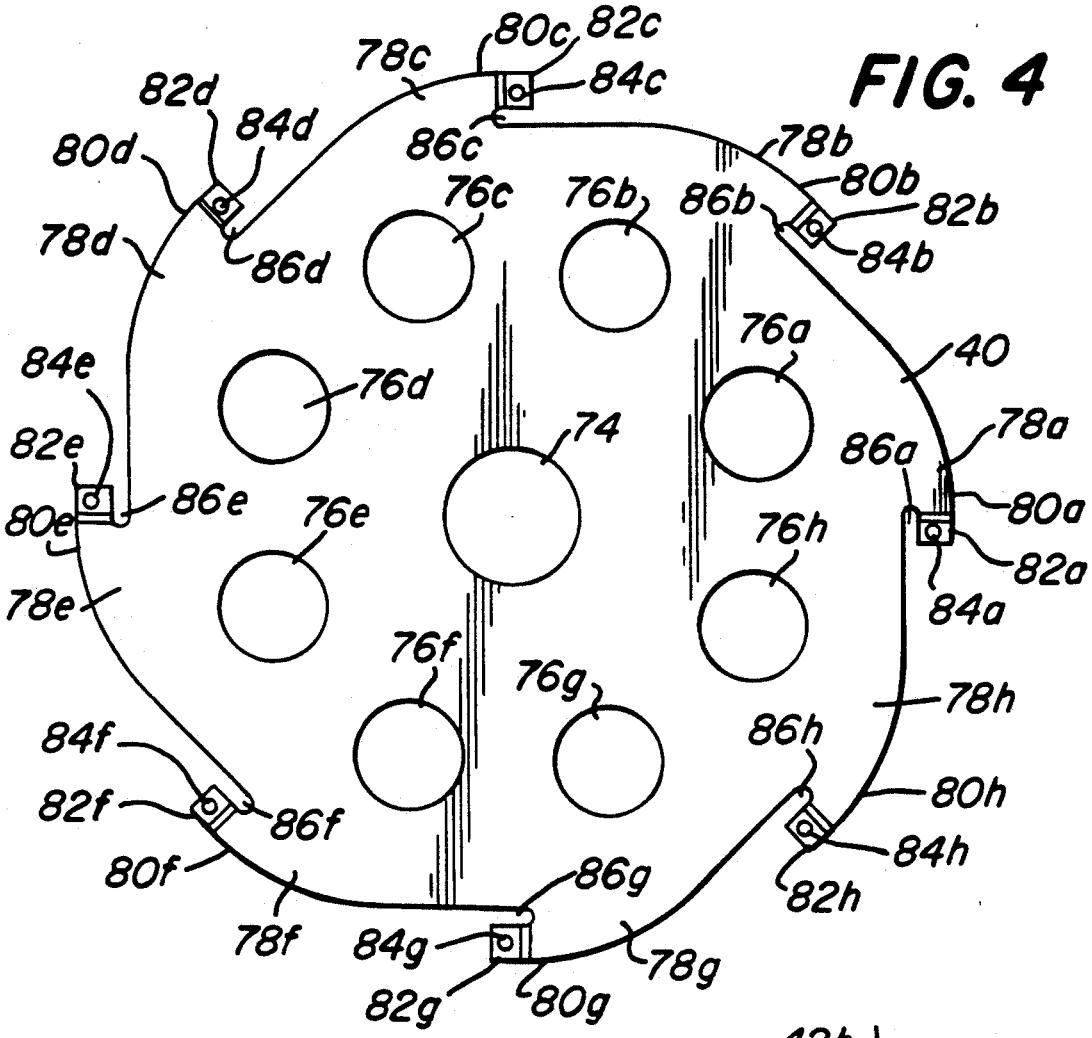
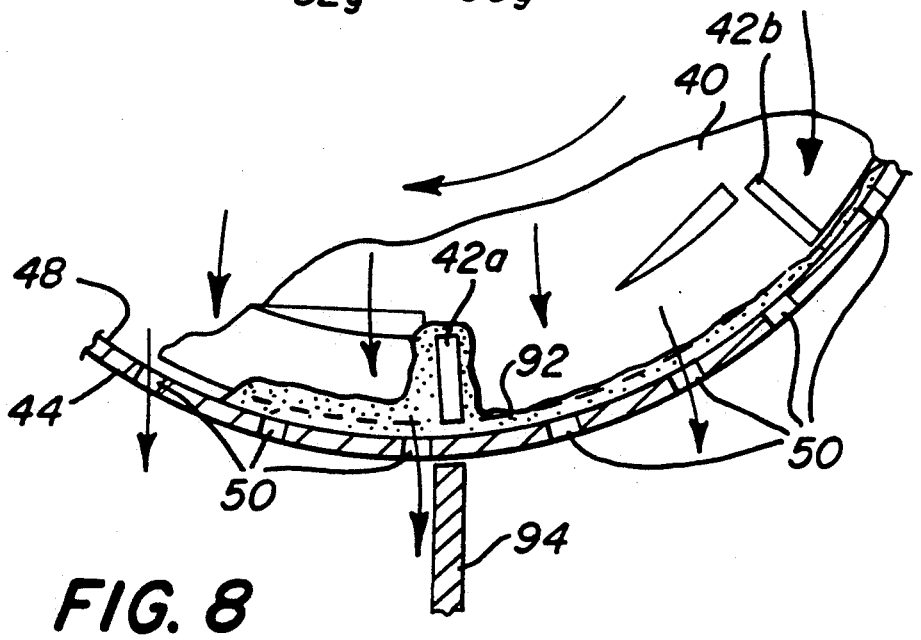
FIG. 8

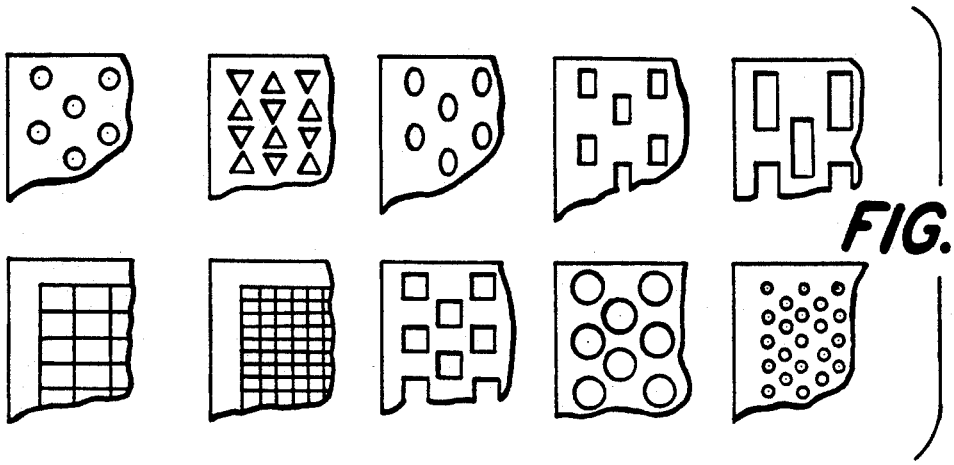
FIG. 5
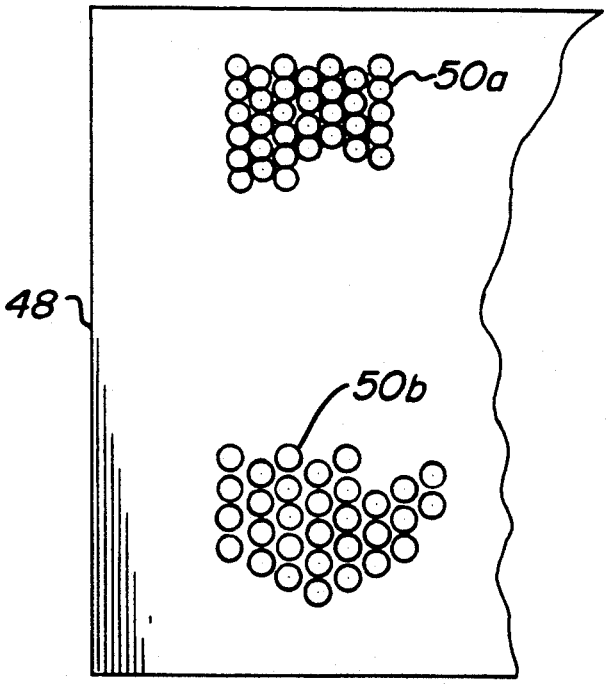
FIG. 6
FIG. 7
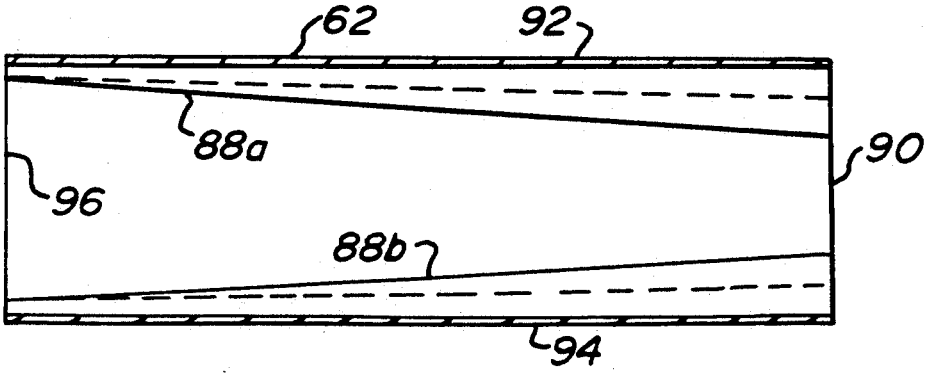

APPARATUS AND METHOD OF MAKING A NON-WOVEN FABRIC

FIELD OF THE INVENTION

This invention relates to the air-forming of webs of random length fibers from a source of dry fibers.

BACKGROUND OF THE INVENTION

It is established technology to disintegrate the pulp derived from a wood pulping mill into fibers, for example, to defibrate virgin pulp via a defibration device, e.g. hammer mill, grinding mill. The fibers are transported through conduits, usually moved by forced air, to an area adapted for fiber deposit and fibrous web formation. The very nature of air transport causes the tangling and clumping together of the fibers. Various devices are known to effect fiber deposit to attain control of fiber laydown and to gain a substantially uniform web thickness. These devices involve what may be called a sifting apparatus, such as an agitator means positioned above an apertured screen for causing fibers to pass through the apertures or openings in the screen to a receiving member, usually in the form of a moving wire or belt.

For example, a rotary impeller means may be provided to detangle and declump the fibers, and to distribute the fibers over a sifting screen, seeking a uniform deposition of fibers on a traveling perforated belt, known in the art as a "former wire." The impeller disposed within an open fiber distribution housing may rotate upon horizontal axes that are aligned in parallel to the plane of the forming wire. These axes extend transversely of the direction of "wire" movement.

One prior open fiber distributor housing having a cylindrical chamber with its arcuate bottom wall perforated for distributing fibers onto the forming wire uses, as the motive force for moving the fiber, air suction as well as a helically-bladed rotor with the rotor axis essentially coincident with the cylindrical chamber axis of curvature. This arrangement serves to distribute the fibers in close proximity to the screen and substantially evenly distributes them along the transverse length of the chamber. Air suction then causes the fibers to be drawn through the screen and be deposited on the forming wire. See, U.S. Pat. No. 4,627,806 [Johnson] issued Dec. 9, 1986.

Major concerns in the formation of fiber webs are achieving uniformity across the entire web which includes uniformity in basis weight, lift, entanglement, and resolving the difficulty in providing consistent fiber orientation for maximum cross-strength of the resulting web. Erratic production results are still experienced, as the web commonly experiences orientation of fibers in the machine direction due to the air suction. This results in loss of strength in the web in a cross-machine direction. Another, and equally more difficult obstacle to uniform web formation, is the frequent occurrence of fiber clumps or nits due to the air suction drawing small fiber clumps through the screen.

Prior air suction systems, long used to pull the collecting fiber through a sizing screen, such as standard air exhaust means, are plagued by the flow distortions created by fiber clumping and erratic aperture blocking in the sizing screen. This creates distorted fiber flowthrough patterns from the fiber distribution housing, and so markedly interferes with achieving a uniform depositing of fiber, a balanced loft and basis weight in the resulting web.

In the present invention, it is intended that the arcuate screen have a fiber deposition or "coating", fostering a positive pressure build-up in a closed fiber distribution housing, followed by the high frequency repetitive wiping and fiber clearing action by a high-RPM helically arranged blades of a rotor means. The building of positive pressure applied to the closed distributor housing, rather than air suction applied from below the former wire, is a chief factor in accomplishing randomized fiber flowthrough across the entire field of the machine. This action fosters a more uniform fiber descent through a vertically oriented duct means for preventing external influences upon the virtually free-falling fibers.

It is, therefore, a principle object of the invention to provide an improved air-laid, non-woven fibrous web making process, in terms of the varied sources of feedstock and reduced fiber waste in their conversion to formable fibrous web structures. It is another object of the invention to provide an air-laid, web making process which is better adapted to short production run applications, like for non-wovens which may be utilized in the premoistened and industrial wipe markets, and to enhance the inherent economic advantages of producing non-wovens from a variety fiber sources.

Still another object of the invention is to provide a process with a significantly reduced environmental impact, including energy conservation, by avoiding significant toxic chemical waste, vaporous pollutants, and by requiring markedly less process water elimination than used in conventional paper making. Yet another object of the invention is to provide a process for using fiber feedstocks from a variety of fiber sources (wood pulp, newsprint, telephone directories, office waste paper, synthetic fibers etc.), and effecting random fiber lengths that will ultimately yield non-wovens of acceptable fabric bulk and desired physical properties.

Other objects will appear hereinafter.

SUMMARY OF THE INVENTION

The invention relates to an apparatus and method for the dry-forming of fibrous structures or webs at comparatively rapid production rates, and more precisely, to the dry-forming of a fibrous web, including fibers of up to one and one half inches in length. In a preferred embodiment of the invention, the apparatus and method are adapted to form a declumped, detangled evenly distributed fiber mass, which can be deposited upon a standard forming belt or wire conveyor. This process provides a fiber web in the basic weight range of from four to upwards of two hundred pounds per ream. The most common feedstock for this process is made from conventionally-defibrated wood pulp, which can create mainly individualized pulp fibers. Such fibrous material is removed by suction from the defibration device, using a dry fluid medium, like air, to enter a unique fiber declumping and distributing device.

During fiber transport, partial fiber tangling causes clumping; such tangles need to be declumped before actual delivery for web forming. The fiber processing apparatus includes a rotor chamber that features a bidirectional rotor means having a plurality of upstanding transverse blades projecting radially outward at its periphery. A rotatable baffle upstream of the rotor means interrupts and deflects the randomized fiber upon entry into the rotor chamber from the transport conduit. The rotor blades circulate such randomized fibers throughout the rotor chamber to collect, by gravity, onto a slightly offset arcuate screen means, which confronts approximately about one half of the outer periphery of the blade path. The declumped, detangled individualized fibers collected on the screen means will flow forcibly through the arcuate screen from the accumulated positive air pressure created by the dry fluid transport means in the rotor chamber to a vertical duct means adapted for starting web formation.

The arcuate screen means provides a temporary deposition zone for clumped and unclumped fibers, while also impeding the dry transport fluid flow therethrough, creating the positive pressure upstream of the arcuate screen surface. This positive pressure is enhanced by fiber deposition on the upper surface of the arcuate screen.

The plural spaced-apart blades have a preferably helical configuration, the leading edges of which sweep in close tolerance to, and are adjustably offset from, the arcuate screen means. This provides a screen wiping step, in the nature of a declumping and detangling action that strikes the ensnared clumps, declumping and detangling them into individualized random length fibers by directing the swept away fibers upward into the rotor chamber and leaving a thin coating of detangled individual random length fibers deposited against the upper surface of the arcuate screen. The pressure build-up in the rotor chamber blows or pushes such fibers downstream by passing through the perforations in the screen, to be deposited by descending in substantially a free-fall through the vertical duct or chute means onto the forming wire located above a fiber capture means. The air flow rate of the fiber capture means is selected to be equal to or slightly greater than the air transport rate into the former chamber to achieve the even distribution and depositing of different types of fibers on the wire conveyor.

In this embodiment no secondary air pressure source is required for the declumping zone in the rotor chamber so as to untangle fibers and to move them through the arcuate screen means. With a lesser air flow being needed to form the air-laid mat or web on the forming wire, better overall process control and web dimensional stability is achieved, substantially better than that seen in conventional formers. The arrangement and configuration of the moveable elements in the rotor chamber cause the fiber fed into this chamber to experience some air turbulence which aids in dispersing, detangling and declumping the fiber as the fiber comes into contact with these elements.

The blades of the rotor are similar in configuration and arrangement to the helical array of blades used on manual-type lawn mowers. However, the rotor blades of the invention do not require a close tolerance striker plate needed for an effective fiber cutting or shearing function (e.g. "grass mowing") like that of U.S. Pat. No. 4,389,175 [Sakochek]. Rather, the blades need only be sufficiently close to release random fibers and sweep the clumped (unpassed) fibers from the opposing sizing screen to effect the declumping and detangling action and assist in the forcible flow of fibers pushed through the screen by the developed air pressure in the rotor chamber by leaving a thin coating of individualized fibers lying against the screen.

Additionally, an adjustable angle baffle means is interposed in the fiber inlet stream above the rotor in the upper portion of the rotor chamber to deflect and direct the dry fluid entrained defibrated fiber stream upon entering the former means. The arrested fiber falls by gravity onto the rotating reel or impeller, while the slowed transport air disperses about the rotor chamber area building up a static, positive pressure for effecting randomized fiber flow through the arcuate sizing screen. The individualized fibers which traverse through the arcuate sizing screen are then directed downward through the vertical duct means to a web-forming wire, or belt, on which a fibrous structure or web is formed. The resulting web is processed by steps known in the art to form the non-woven products associated with the present invention.

Air is the preferred fiber transport medium, and requires an ancillary air source needed to offset the high suction air rates in prior art devices. The novel teaching here of not using suction air flow in the former means greatly reducing the number of deleterious defects in the fibers which are pulled through the screen and which adversely affect web quality.

BRIEF DESCRIPTION OF THE DRAWING

For the purpose of illustrating the invention, there is shown in the drawings forms which are presently preferred; it being understood, however, that the invention is not limited to the precise arrangements and instrumentalities shown.

FIG. 4 is an elevational view of one of the plural spider plates which serves to orient and support each of the plurality of helically arranged blades of the rotor means of the fiber declumping, detangling means of the present invention.

FIG. 5 is a top plan view of various arrangements of apertures showing different size, shape and placement for the arcuate sizing screen of the fiber declumping, detangling means of the present invention.

FIG. 6 is a top plan view of the arcuate sizing screen showing two aperture arrangements for regulating the transport air and individualized fiber outflow from the rotor chamber of the fiber distributor housing of the present invention.

FIG. 7 is a top horizontal sectional view of the twinned adjustable baffles for capture air flow balancing in the cross machine direction taken along line 7—7 of FIG. 2.

FIG. 8 is an enlarged sectional view of the wiping action of the rotor means and arcuate sizing screen of the declumping, detangling means of the present invention.

DETAILED DESCRIPTION OF PREFERRED EMBODIMENTS OF THE INVENTION

The following detailed description is of the best presently contemplated modes of carrying out the present invention. This description is not intended in a limiting sense, but is made solely for the purpose of illustrating the general principles of the invention.

Figure 1:
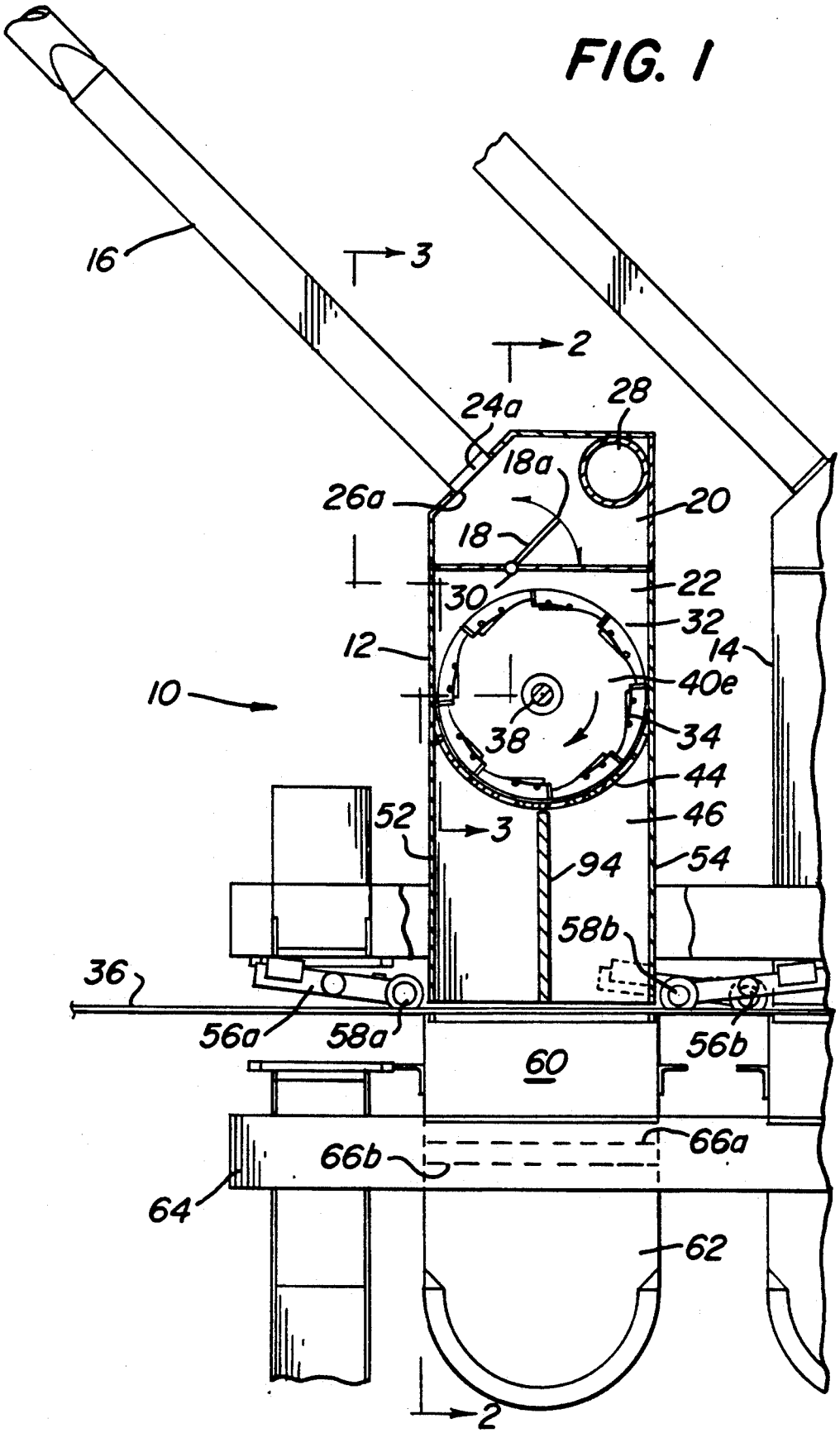
FIG. 1 is a side elevational view, with an end panel partially broken away, of one former means of a fibrous web forming apparatus of the present invention adapted for providing randomized cellulosic fibers to an underlying former wire.

Referring now to the drawings in detail, wherein like numerals represent like elements, there is shown in FIG. 1 the fibrous web forming apparatus 10 of the present invention. FIG. 1 depicts one integrated unit (former apparatus 12) having means for depositing a uniform web of dry fibers onto a moving former belt or wire. Offset laterally downstream from the first former apparatus 12 is a companion former apparatus 14, which functions in an identical manner. The former apparatus 14 produces another fibrous web (not shown) that overlays the first formed web from former 12.

Comminuted fibrous material, such as defibrated cellulosic or synthetic fibers, is transported through downwardly inclined air transport or feed conduit 16 toward an inclined rectangular baffle or deflector means 18, located in the upper chamber 20 of the closed fiber distributor housing 22. The feed conduit 16 provides a transition from a high speed dry fluidized stream in a circular cross-section channel to a lower speed fluidized stream having a rectangular cross-sectional channel at a point close to the entry to upper chamber 20 within nozzles 24*a, b* which nozzles are directly connected to the housing 22. The rectangular cross-sectional channel of the nozzles 24*a, b* creates a more uniform dispersion of the air-entrained fibers across the upper chamber 20 of the housing 22. The conduit 16 operably communicates with entry ports 26*a, b* (FIG. 2) of the housing 22 through the respective nozzles 24*a, b*.

In the upper corner of upper chamber header 20 opposite the entry ports 26*a, b* is a transversely disposed cylindrical baffle 28, which precludes the retention or collection of fiber in the upper chamber corner opposite the entry ports 26*a, b* and enhances the air turbulence throughout the chamber. Baffle 28 can be provided with a linear array of ports or perforations (not shown) of variable cross-sections which are spaced along its length, through which solid additives can be introduced to the entering fibrous feed material. Any metered introduction of one or more additives may be accomplished using one or more mechanical auger means (not shown) operatively located within the cylindrical confines of baffle 28.

The rectangular rigid baffle or deflector 18 is moveable about an axle 30 for causing the interruption of the inward flow and the deflection of the entrained fibrous material. The axle 30 is disposed and extends across the width of the upper chamber 20 of the housing 22 and through the side walls of the former 12 for control of its angular position by a handle (not shown) outside the housing. Axle 30 provides the point of support about which the movable baffle or deflector means 18 is able to rotate. The baffle or deflector 18 is capable of rotational movement manually about the axle 30 through a nominal 180° arc between opposing horizontal orientations. The baffle or deflector means 18 is pre-aligned to create the desired feed fiber deflection for the particular air entrained feed material which is designed to intensify the existing turbulence in the upper chamber 20 from the fiber entering through the ports 26*a, b*. The arcuate rotation of baffle 18 varies from 0° (longitudinally aligned with the fiber inflow direction, presenting no baffle effect) to 90° angular relationship shown where the baffle presents a maximum fiber inflow impediment or deflection. The baffle 18 can also be moved farther clockwise (>90°) for a lesser deflection effect.

As depicted, the baffle or deflector means 18 is about six inches in height, which can be enlarged up to an additional 50% as needed, provided that the leading outer edge 18*a* does not contact the header sidewalls, the cylindrical baffle 28, or physically obstruct the feed entry ports 26*a, b* of feed conduit 16. The longitudinal (machine-width) length of baffle or deflector means 18 will be commensurate with the width of the upper chamber 20 with only minimal endwall clearances.

Figure 2:
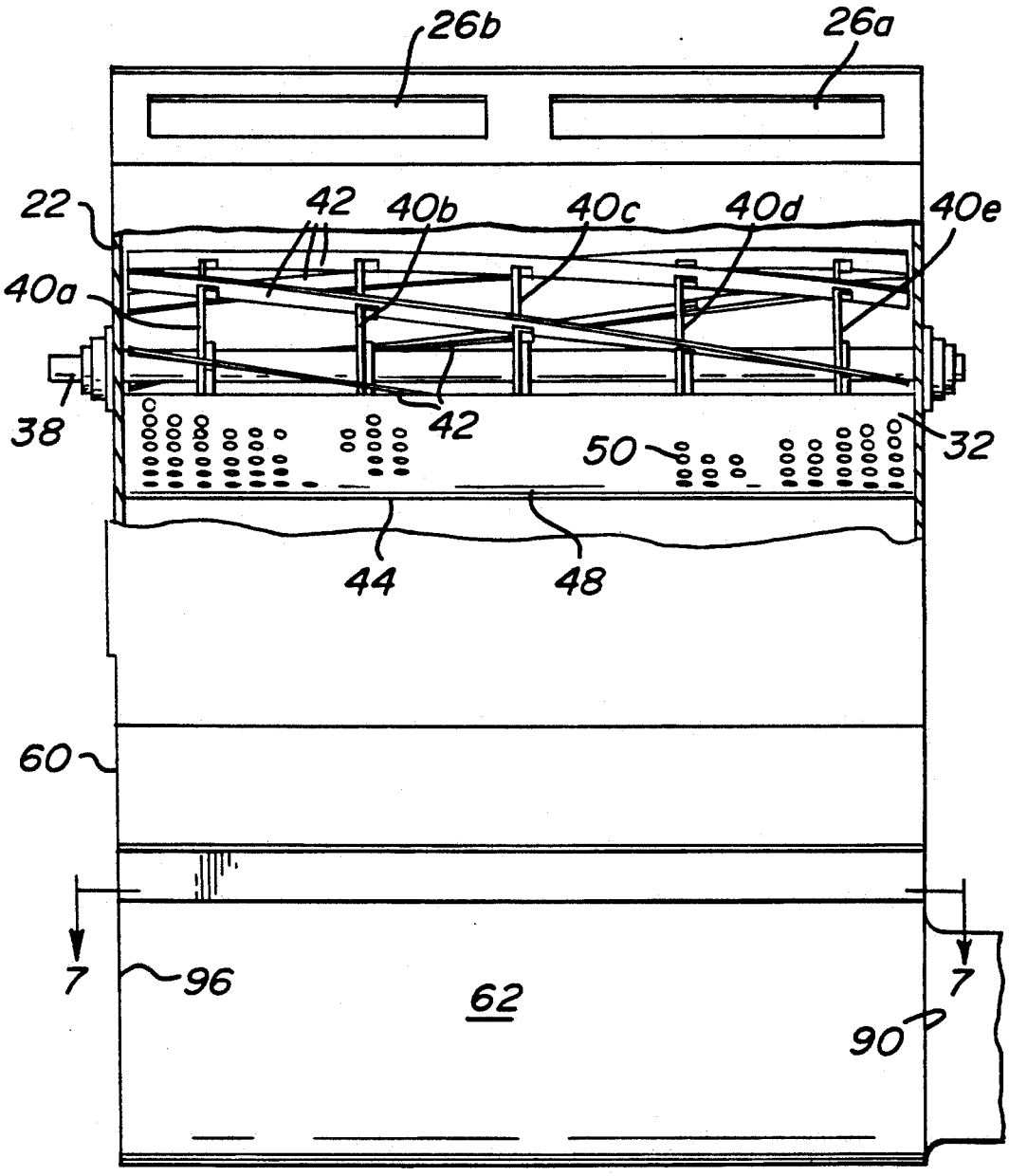
FIG. 2 is a front elevational view in a cross-machine direction, with a side panel partially broken away, showing the rotor chamber of the fiber distributor housing of the web forming apparatus of FIG. 1, taken along line 2—2 of FIG. 1.
Figure 3:
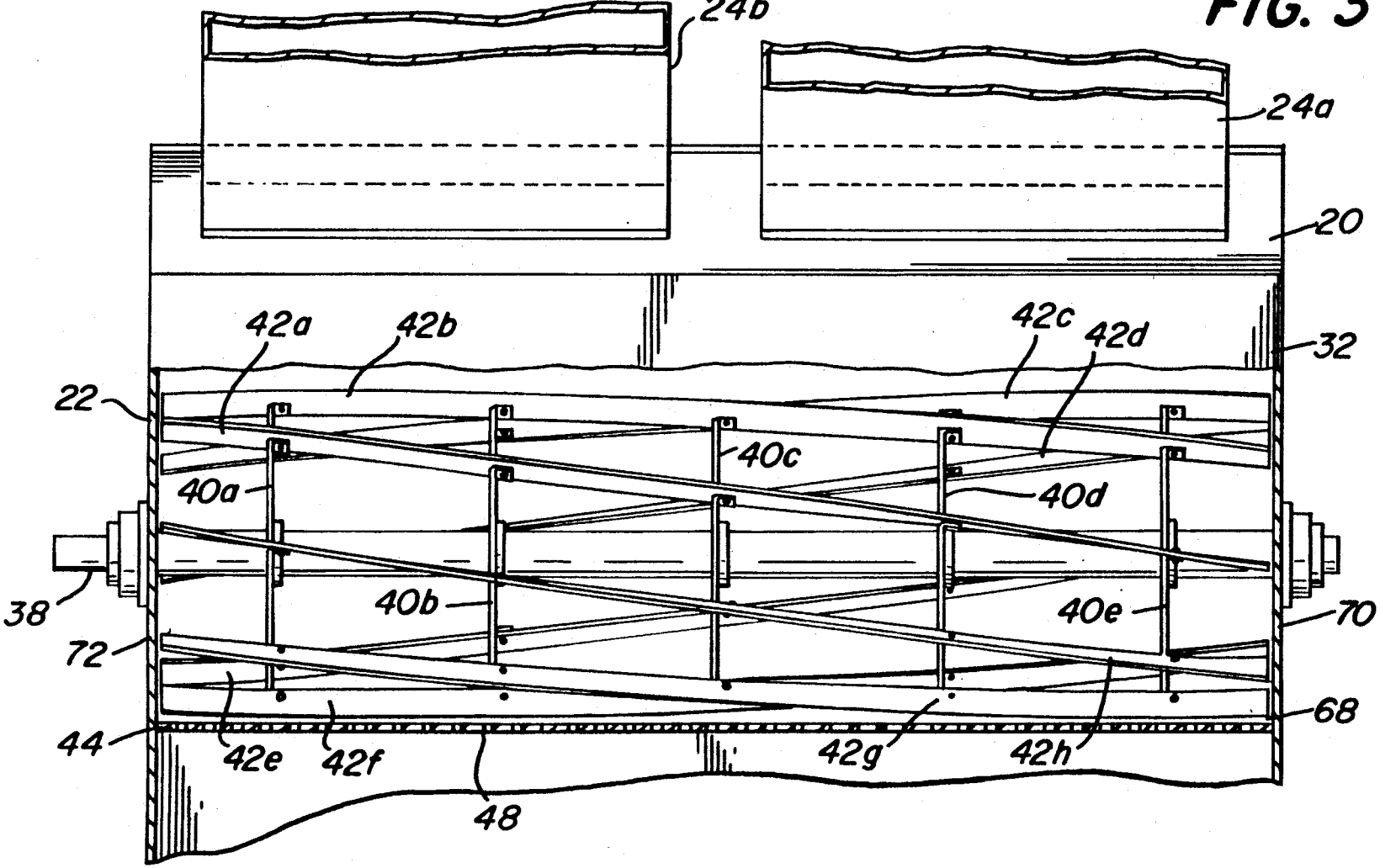
FIG. 3 is a front elevational view in a cross-machine and direction, with a panel partly broken away, showing the fiber distributor housing and rotor chamber showing the flow declumping, detangling means taken along line 3—3 of FIG. 1.

Referring briefly to FIG. 3, it can be seen that a pair of feed conduit nozzles 24*a, b* form the bridging structures between the feed conduit 16 and the upper chamber 20 of the housing 22. The open end portions of the nozzles 24*a, b* form the rectangular entry ports 26*a, b* (FIG. 2), the linear dimensions of which ports are in the range of 4"×25". The overall width dimension of the distributor housing 32 for purposes of this description is 60".

Returning again to FIG. 1, there is centrally disposed in the fiber distribution housing 22, and below the upper chamber 20, a lower chamber 32 housing a single rotor means 34. The rotor means 34 is oriented such that it extends across the lower chamber 32 and has its horizontal axis aligned substantially parallel to the surface of the underlying former wire or belt 36. Rotor means 34 is capable of rotating at varied speeds depending upon the fiber content of the feed material. The axle or shaft 38 of the rotor means 34 is coupled to a motor (not shown) through one of the opposing end walls of the lower chamber 32.

The rotor means 34 is provided along its axial length with several planar spiders or blade-mounting plates 40*a–e*, to each of which several blades 42 (FIG. 3) are secured. The spiders 40*a–e* are spaced-apart transversely along the shaft 38, all being pinned to the rotor shaft 38 at pre-selected intermediate positions. These spacings accord with the number and curvature of the rotor blades being employed, as will be later detailed.

With regard to the number of spaced-apart blades or impeller means 42, the present invention works most effectively with a plurality of blades, there being at least two diametrically opposing sets, and preferably using three to five sets on the rotor means 34. The sets of blades or impeller means 42 create a helical arrangement about the rotor shaft 38 when fixedly attached to appropriately spaced spiders 40 resulting in a similar configuration as in the reel of a manual or push mower.

The increased frequency of blade impact, fiber mixing, and turbulence resulting from the fan action of the blades in both upper and lower chambers 20, 32 of the fiber distribution housing 22, along with the rapidity of blade or impeller means 42 impacting against the collected fiber, and wiping action across the juxtaposed arcuate sizing screen 44, provide a "shotgun" effect of randomized fibers moving through the screen means 44. The increased or higher RPM of the rotor means 34, which is made feasible with the preferred multiblade arrangement, leads to higher throughput of declumped, detangled, randomized fibers and results in production levels of fibrous web ranging up to 350 lbs. per hour per former 12, 14. The required curvature of a single blade, so as to fully span its portion of the circumference of the rotor means 34, provides a staggered sweeping of the fibers deposited on the screen means 44, and also fosters fiber flowthrough.

The distance from upper chamber 20 of the housing 22 to the horizontal axis of the shaft 38 of rotor means 34 is preferred to be approximately 1.5'–2'. The radial distance of the rotor means 34 from its shaft 38 to the screen 44 is dependant upon fiber length and, for processing most fibers, is preferably 9". The distance from the nadir of the arcuate screen 44 to the former wire 36 is approximately in the range of 30" to 36". All dimensions as set forth are in accord with the representations of the described configuration and should not be considered in a limiting sense for smaller or larger forming apparatus, or for unusual fibers.

Disposed in close proximity to the arcuate sweep path of the edges of the blades or impeller means 42 is a concentrically arcuate, screen means 44, which separates the rotor means 34 and the lower chamber 32 of the fiber distribution housing 22 from the vertical duct or chute means 46 of the former 12. Screen means 44 comprises a screen 48, in the form of a wire mesh or a foraminous surface, through which random length, declumped and detangled fibers are discharged by the positive air pressure developed in the upper and lower chambers 20, 32 (the rotor chamber) of the distribution housing 32 to fall (principally by gravity) through the chute means 46 and collect on the former wire 36. Former wire 36 is horizontally disposed, and moving rightwardly directly under the chute means 46.

Arcuate screen means 44 is shown in a top perspective view in FIG. 6, as the screen 48 would present itself to the swirling, rotating fibrous mass. The apertures 50 are preferably linearly arrayed, and disposed transversely across substantially all of the arcuate surface, in staggered rows, providing a variable range of effective open space from 20% to 95%. FIG. 6 depicts closely positioned apertures 50*a* and minimally spaced apart apertures 50*b* to accommodate different feed materials (natural, synthetic or a combination of both) and formed web specifications. For cellulosic fiber, the arrayed apertures are generally rounded, and are sized relative to the inherent bulk weight per unit volume of the defibrated feed stock. The aperture diameters can range between 0.15" and 1.5".

The screen 48 extends across the bottom of the screen means 44 in an arcuate configuration immediately below the rotor means 34. The screen 48 traverses slightly less than 180° of its arcuate length when in functional juxtaposition to the periphery of the rotor blades or impeller means 42.

Arcuate screens 48 having different arrangements, sizes and shapes of apertures 50 are intended as interchangeable elements in the former apparatus 10 so as to provide for the varied sizes and lengths of feed stock fibers. Oval, rectangular or triangular apertures may also be selected for sized screening of fiber feed stocks. Square apertures are usefully provided with standardized wire meshes. Reference can be made to FIG. 5 for showing a variety of different shapes of apertures which may be utilized for the variety of fibers which can be used to form webs using the former apparatus of the present invention.

Enlarging aperture diameters (if circular) or changing aperture size and dimension, while maintaining rotor RPM, causes a proportionate increase in the production of fibrous web laydown on former wire 36. Man-made or synthetic fibers, such as polyolefins and polyesters and even fiberglass, which normally have longer average fiber lengths (¼" and larger) and cellulosics, like rayon, may require larger area apertures to maintain comparable web production rates. Cellulosic feed stocks derived from virgin wood pulp can be processed to enter the former as random fibers of 2–5 mm. lengths. For fiber lengths of 1½", the use of circular or rectangular sizing screen apertures is preferred. Where available, man-made fiber (like rayon) of lengths of 1–2 mm. are processable on the same arcuate screen dimensions that serve for cellulosics. Even steel wool can be processed, preferably on rectangular apertures. The matching and flow rate optimization of feed stock fibers and screen configuration are believed to be within the knowledge of those skilled in the art.

Located on both sides of the vertical sidewalls 52, 54 of chute means 46 are a pair of spring-biased arms 56*a, b* which have axially-pinned, sealing rollers 58*a, b*, rotatably mounted at their free ends. The rollers 58*a, b* are motor driven at the speed of the belt 36, and counterbalanced to serve to bias the moving belt 22 to provide an air sealing capability keeping ambient air from being drawn into, or chamber air leaking from, the fiber free-fall chamber or chute means 46 proximate to the forming wire 36 and interfering with the uniform distribution of fibers across the web. Rollers 58*a, b* serve to seal or block off any air leaking from chute means 46 and the drawing of ambient external air into the air capture means 60, which is disposed below the former belt 36. In this manner the fiber web is substantially undisturbed and the distribution of fibers as passed through the screen means 44 remains substantially uniform across the entire web.

Exhaust air outflow conduit 62 is supported on a longitudinally-extending support 64 and located below the former wire 36 and air capture means 60. Disposed within the vertically oriented air capture means 60 is a pair of overlying rigid, perforated plates or screens 66*a, b* (having a space or gap between them). The plates 66*a, b* are adjustable to regulate airflow and serve to provide a more uniform air flow rate through the air capture means 60 and into the depending outflow conduit 62. The configuration of these lower perforated plates or screens 66*a, b* to achieve the more uniform distribution of the air being drawn through the overlying former wire 36 is preferably of a rectangular structure with 16" width (in the machine direction) and 54" length or depth (in the cross-machine direction) with a thickness in the range of 0.4" to 0.6".

FIG. 6 shows two sets of perforations or apertures 50, each providing a different net open area which can be utilized in the lower screen means 66*a, b*. In practice, only one consistently sized, array of perforations are employed in a given machine. The upper array of perforations or apertures 50*a* provides about a 60% open area. The circular perforations can range from ¼" to ½" diameter, with their spacing determining the percent open area within the perforated perimeter. For example, with ½" diameter holes, the hole centers are 0.572" from one another. The lower array of perforations or apertures 50*b* provides a 40% open area, with ½" diameter holes, and the hole centers from one to another being 0.696".

Further, any of the various perforation or aperture alignments shown in FIG. 5, in which the perforations are in linear, staggered rows, may be used in the lower screen means to permit a balancing of the air flow through the former wire 36 and the air capture means 60 and into the outflow conduit 62. In a specific working embodiment, only one of the two arrays of perforations or apertures 50 would be aligned across the shorter dimension of the plates 66*a, b*.

Referring now to the partially broken away vertical sectional view of FIG. 3, the broken away portion of the lower chamber 32 of the distribution housing sidewall reveals the multi-bladed rotor means 34, which converts the air-transported fibrous material into a detangled, declumped, randomized length, mass of fibers which collect against the upper surface of the screen 48. Rotor means 34 is shown with four sets of paired blades or impeller means 42*a–h* arranged equidistantly about the planar support plates or spiders 42*a–e*. At least four blades 42 equispaced about the rotor are deemed to be the minimum number of blades or impeller means 42 suitable to provide the quality of fibrous web to be produced in accordance with the present invention.

The pitch of each blade, like 42*a*, is defined as the degree of inclination that such blade deviates from a perpendicular incidence relative to arcuate screen 44. A particular blade pitch is required in the present apparatus, whereby each blade sweeps at a perpendicular or normal attitude to the arcuate screen means 44, thus resulting in the depicted helical blade arrangement.

By the preferred use of at least four pairs of peripherally positioned blades 42, each pair being diametrically opposed along the radial arc of the rotor 34 as described by the profile of the spiders 40, a consistent declumping of the introduced fibers in the machine direction is accomplished. Additional properly spaced blades sets will increase the wiping and declumping effects of the rotor as well as effect the fan action of the rotor means 34 in creating increased air turbulence within the lower chamber 32 of fiber distribution housing 22 to actively assist in the detangling and declumping process.

A single blade 42 has a facing edge dimension of 0.157" with a blade width of 1.375". A clearance or gap 68 is provided between the deepest reaching edge of blade 42*g* sweeping the opposing arcuate surface of screen 48. This gap is adjustably set between 1.0 mm and 10.0 mm, with the adjustment of the gap dependent upon the fiber size of the defibrated feed stock. In similar fashion, the gap spacing can be set in accord with the variety apertures 50 of the arcuate perforated screens 48 which can be substituted to further regulate the average size and volume of fibers flowing through the screen 48 into the free-fall chute means 46.

The gap 68 is adjustably set to control the fiber movement through the screen means 44. With a smaller fiber, a thicker layer of fibers is required for uniform movement of the fibers through the screen 44, therefore a larger gap between the rotor means 34 and the screen means 44 is required to accommodate the denser or thicker layer of fibers. For a layer fiber, a less dense or thinner layer is required for controlled throughput of the fiber through the screen 44. Thus, the gap 68, between the rotor 34 and the screen 44, is adjustable by moving either the rotor 34 or the screen 44 slightly toward or away from the other in accordance with the fiber movement required through the screen means 44 for a uniform web to be formed below.

The overall dimensions of the rotor means 34 can be described as follows. A suitable diameter for the rotor is almost equal to the internal diameter of the arcuate screen 48, approximately 18", measured from the outer edge of one blade to the outer edge of the diametrically opposite blade of the set. Thus, the aforementioned small gap 68 will exist due to dimensional criticality. For this exemplary rotor diameter, the radial distance from the rotor axis to the arcuate screen surface 48 is approximately 9" (including minimum gap 68 specifications). The transverse width of rotor 34 will be approximately 55", which serves to maintain a minimal lateral clearance with the endwalls 70, 72 of former 12. The rotating axis of rotor 34 is journaled through the endwall 72 of the rotor chamber, by means well known in the art, for effecting motive power from an external motor or drive means.

Power for the rotor means 34 is from a direct drive, variable speed, DC motor (not shown) which is mechanically linked to one projecting longitudinal end of the rotor axle 38. Rotor means 34 is operated in the range of 50 to 5000 RPM, with 50 to 1850 RPM being the optimum range. The rotor direction is reversible, but is preferably coordinated with the former belt motion rotating clockwise with the former belt machine direction moving to the right as indicated in FIG. 1.

It can be seen in FIG. 3 that the spacing apart and curvature of each of the helical blades is determined by the rotational configuration of the planar support plates (or spiders) 40, mounted on the rotor shaft 38. Five such spiders are depicted, 40*a–e*. The planar configuration of one such plate 40 is best shown in FIG. 4, as it appears before peripheral tabular bending, and the multi-plate assembly on rotor shaft 38 has occurred to accommodate blade placement thereon. The central circular aperture 74 serves to slip each spider 40 over an isolated rotor shaft 38 in the process of assembling a complete rotor assembly, suited for mounting in the rotor chamber 22.

For each spider 40, a plurality of eight, equisized circular apertures 76*a–h*, are arrayed equidistantly along a common circle radially approximately 2.5" from the center of the mounting hole 74. This circle defined by the holes 76*a–h* is intermediate of the spider center aperture 74 and its periphery. The apertures 76*a–h* function to dynamically balance each spider 40 and to reduce the weight.

The perimeter of the spider 40 is profiled by a plurality of outwardly projecting legs, like 78*a*, each having a streamlined lateral edge 80*a*, terminating with a free linear end or tab 82*a*, that is radially equidistant from the central mounting hole 74. Deformably integral with the radial edge of each leg 78 is the rectangular rigid tab 82, adapted to bend inwardly (or outwardly) along a line extending radially outward, and thus to present an anchored mounting tab for one planar side of a blade or impeller means 42, such as is depicted in FIG. 3. Each tab 82 may be further provided with a small central hole, (like 84*a*), ¼" in diameter, to admit the shank of a blade fastener, such as a rivet (not shown). The inner corner along the inward facing edge of each tab 82 is also undercut with another hole (like 86*a*), 5/16" in diameter, to facilitate the free bending of the tab. The recessed inner edge of the hole 86 then extends peripherally along the spider 40 to form the next streamlined projecting leg 78.

The distance from the center point of the spider 40 to the inner edge of the hole 86 is 7.0625", with the radial length of the tab 82 being an additional 0.625". The overall diameter of the plate 40, measured from the center of one recessed hole 86 to the diametrically opposed hole, is 14.5". Since lateral edge 80 of the oriented tab 82 will project a maximum of 8.13" from the center point, the blade clearance 68 from the arcuate screen 48 will be adjustable by the selected depth of the helical blade. This permits use of a number of blade dimensions each adapted to provide the desired clearances.

It will be evident that the several spiders 40 which are mounted on the rotor shaft 38 will be radially offset as to tab orientation, to mate properly with the transverse curvature of an individual blade. As the blade depths and numbers used are adapted to different fiber feedstocks, the spiders 40 will be custom mounted and aligned to accomplish the functional assembly shown in FIG. 3 of a helical blade arrangement.

The disclosed former apparatus 12 is capable, upon start-up, of promptly generating a positive pressure buildup in the fiber distribution housing 22 to reach an equilibrium status. The rotatable baffle means 18 serves to markedly reduce the transport air flow rate, and to dampen material flow variations created by air vortices and the like in the upper chamber 20. The baffle 18 also arrests the forward motion of the feed material and disperses the fibers about the upper chamber 20 and into the lower chamber 32.

Referring now to FIG. 7, there is shown a top horizontal sectional view of the twinned adjustable baffles 88*a, b* of the capture air outflow conduit 62, which was earlier shown in front elevational views in FIGS. 1 and 2. The air outflow conduit 62 underlies the perforated air flow control plates 66*a, b* and depicts the large diameter, cylindrical conduit having an upward facing opening to the air capture chamber 60 and is provided with regulatable air flow means or baffles 88*a, b*. The distal end 90 of conduit 62 corresponds to the right side end 90 in FIG. 2.

Air outflow conduit 62 is adapted to provide a constrictable flow pathway, adjusted to balance the air pressure in the former 12 from the transport air, feed fiber rate and product draw-off rates upstream in the fiber distribution housing 32, the chute means 46, and the air capture means 60. Internally disposed of the parallel longitudinal sidewalls 92, 94 (hinged at the proximal end 96 of the conduit 62) the baffles 88*a, b* can be oriented to provide modest air flow portal constriction (16" diameter at the upstream end and 18" at the downstream end) at the air outflow portal 90 at a first setting. As needed, these baffles 88*a, b* can be moved farther inwardly at their downstream ends to further constrict the flow cross-sectional diameter from 13.5" to typically a minimum of 8.5" to balance cross-machine air distribution to provide a more uniform distribution of air, and fibers, around the former wire 36. A ratcheting mechanism for control of the translation of the baffle free ends, between maximum and minimum flow pathway (not shown) can be used and is within the knowledge of one skilled in the mechanical arts.

The rotor means 34 in combination with the screen means 44 creates a "snow storm" effect of individualized fibers falling downward to generate a web suitable for conversion into non-woven products. Referring now to FIG. 8, there is shown the detail of the wiping action occurring between the rotor means 34 and the coating 92 of individualized randomly oriented fibers on the surface 48 of the screen means 44. As the blades or impeller means 42, and more particularly blade 42*a*, one can see that the fiber coating 92 which collects against the surface 48 of the screen means 44 through the effects of gravity and the positive air pressure developed in the fiber distribution housing 22 is pushed in the rotational direction of the blades or impeller means 42 leaving in the wake of the blade 42*a* a thin coating of fibers against the screen 48. The fibers pushed along the surface 48 of the screen means 44 are propelled upward into the upper reaches of the fiber distribution housing 22 (into the upper chamber 20) to resettle against the screen means 44 after the air turbulence in the fiber distribution housing 22 continues to effect the separation of individualized fibers one from the other. The fibers remaining in the thin coating 92 lying in the gap 68 between the instantaneously active blade or impeller 42*a* and the screen surface 48 and in the immediate wake of said blade are acted upon by the positive air pressure in the fiber distribution housing 22 (and the rotor chamber 32), which air pressure is denoted by the downwardly directed arrows indicating air flow through the apertures 50 in the screen 44. As the air pressure builds up in the rotor chamber 32, it will seek an escape through the plurality of apertures 50 in the screen means 44 carrying with it individualized fibers, thus creating the "snow storm" effect of individualized random length fibers into and through the vertical duct or chute means 46. Therefore, the unique arrangement of the rotor means 34 having plural sets of diametrically opposed blades or impellers 42 mounted about its periphery in a helical arrangement in close juxtaposition to an underlying screen means 44 such that the blades 42 almost contact the underlying arcuately shaped screen 44 creating a thin fiber coating 92 upon the surface 48 of the screen 44 in the immediate wake of each of the rotated blades or impeller means 42*a–h* where such thin coating of fibers 92 is then susceptible to the positive air pressure built up in the fiber distribution housing 22 to force individualized fibers through the apertures 50 of the screen means 44.

Once the individualized fibers exit the screen means 44, they are virtually in free-fall through the gravity dependent vertical duct or chute means 46 until the fibers contact the underlying former belt or wire 36 to begin formation of the desired fiber web. It has been found that within a single vertical chute means 46, which limits the effect of any force other than gravity to control the downward path of the now individualized fibers onto the underlying web, more than single web layers can be formed. Normally, in order to effect subsequent layers in a given web, it has been necessary to use successive former apparatus 12, 14 in an in-line manner with the former wire 36 continuing through the lower portions of each successive former apparatus. It has been found that an improvement in the air laying of fibers can be achieved by partitioning the vertical duct or chute means 46 with one or more vertical partition walls which will vertically separate the duct or chute means 46 into two or more segments. This separation effectively creates a multiplicity of chutes within a single former apparatus 12. The vertical duct means 46, segmented into two sections (as shown in FIG. 1) will create two (2) layers in the web before exiting the former 12. The partition wall 94 is vertically oriented between the walls 52, 54 of the duct or chute means 46 and extends from a position immediately adjacent the underside of the screen means 44 to a position just above the former belt or wire 36. Any gap which exists between the partition 94 and the screen means 44 is intended to be less than 1 mm. and the gap between the lower end of the partition wall 94 and the former wire 36 is sufficient only to permit the loft of the layer of the web from the immediate upstream chamber or segment of a vertical duct or chute means 46 to enter the downstream segment without physical impediment. The addition of one or more vertical partition walls, like 94, enhances the ability to create multiple layers of the non-woven web within a single former apparatus 12.

The present invention may be embodied in other specific forms without departing from the spirit or essential attributes thereof and, accordingly, reference should be made to the appended claims, rather than to the foregoing specification, as indicating the scope of the invention.

I claim:

1. A method of fabricating a web of non-woven fibers in a dry fiber web-forming apparatus from one or more fiber feedstocks comprising the steps of:

a) providing a continuous supply of defibrated feedstock of randomly sized individual fibers;

b) conveying the defibrated feedstock supply in a dry fluid stream into a transition zone for reducing the flow rate of the fluid-entrained fiber stream including fibers having partial tangling or clumping;

c) deflecting the fluid-entrained fiber stream by a first baffle means adapted to slow the flow of said stream and deflect the fluid-entrained fiber into a closed fiber processing means;

d) circulating the fibers within the fiber processing means to deagglomerate any partially tangled or clumped fibers through contact with and fluid turbulence created by a rotor means, depositing a layer of random dimension individual fibers upon an arcuate screen means adjacent said rotor means;

e) intermittently and continuously contacting the individual fibers accumulated on the screen means by a wiping action of the rotor means to cause the layer of individual fibers to be reduced by reintroducing a portion of said fibers into the fiber processing means with the remainder of the layer of individual fibers remaining in place against the screen means;

(f) pushing individual fibers from the remainder of the layer of individual fibers through said screen means by the positive fluid pressure built up in the fiber processing means and by the wiping action of the rotor means;

g) conveying the individual fibers pushed through the screen means to free-fall through a vertical chute means for collection on an underlying web-forming means upon which consecutive layers of the web are formed.

2. The method of claim 1 comprising the further step of providing a second baffle means adapted to prevent the collection of the deflected fluid-entrained fiber in the upper corner of the fiber processing means opposite the fiber entry port.

3. The method of claim 2 comprising the further step of providing means within said second baffle means to introduce metered amounts of additive material to be formed into the web with the fibers.

4. The method of claim 1 comprising the further step of providing one or more partition means vertically oriented within the chute means for separating the free-fall channel within the chute means into one or more channels so as to form consecutive layers of the web on the underlying web-forming means within a single web-forming apparatus.

5. The method of claim 1 comprising the further step of providing at least one perforated planar plate aligned horizontally below the web-forming means to balance the pressure of the transport air from the fiber processing means and vertical chute means with the pressure in an air capture means, to maintain a small positive downward pressure upon the web-forming means.

6. The method of claim 1 comprising the further step of providing a pair of idler rollers located adjacent and external of the opposing sidewalls of the chute means and above the web-forming means functioning to maintain and regulate transport air leakage from and outside ambient air into the forming apparatus.

7. The method of claim 1 comprising the further step of adjusting the dimensional distance between the rotor means and the screen means for controlling the uniformity of distribution of the individual fibers through said screen means as a function of individual fiber size and thickness of the layer of individual fibers.

8. A forming apparatus for fabricating a web of non-woven fibers created from one or more fiber feedstocks comprising:

a) means for conveying individualized fibers entrained in a dry fluid transport medium into a flow transition zone adapted for reducing the flow rate of the fluid-entrained fiber stream;

b) a first baffle means interposed in the fiber stream adapted to disrupt said stream and to deflect its fiber component into a closed fiber processing means having a rotor means for impacting and deagglomerating any partially tangled or clumped fibers recirculating the fibers within the fiber successing means, and depositing a layer of random dimension individual fibers upon an upwardly concave, arcuate fiber screen means located in close proximity to, but setoff from said rotor means, enclosing substantial segment of the peripheral path of said rotor means, and being adapted to pass individualized fibers through its many apertures;

d) said rotor means being powered to move in a rotating motion about a concentric shaft axle with the outer edge of each of a plurality of impeller means wiping against the layer of individual fibers accumulating against the upward facing surface of said screening means to uniformly distribute the accumulating fibers and to reduce the layer of individual fibers by reintroducing a portion of said fibers into the fiber processing means with the remainder of the layer of individual fibers remaining in place against the screen means enabling the positive fluid pressure in the chamber and the wiping action to push said fibers through the apertures in the screen means;

e) a vertically oriented chute means adapted for containing and conducting by gravity and positive fluid pressure the individualized fibers to a moving foraminous web-forming means underlying the chute means for intercepting and collecting the falling fibers and for forming consecutive layers of non-woven fibers.

9. The apparatus of claim 8 wherein the plurality of impeller means mounted to the rotor means are comprised of two or more sets of blades equally angularly spaced about the circumference of the rotor equidistant from the axis of rotation, and extending transversely along the rotor means, each of the sets of blades having a helical configuration adapted to span substantially all of its proportionate share of the circumference of the rotor means.

10. The apparatus of claim 8 further comprising a second baffle means adapted to prevent the collection of the deflected fluid-entrained fiber in the upper corner of the fiber processing means opposite the fiber entry port.

11. The apparatus of claim 10 further comprising means within said second baffle means to introduce metered amounts of additive material to be formed into the web with the fibers.

12. The apparatus of claim 8 further comprising one or more partition means vertically oriented within the chute means for separating the free-fall channel within the chute means into one or more channels so as to form consecutive layers of the web on the underlying web-forming means within a single web-forming apparatus.

13. The apparatus of claim 8 wherein at least one perforated planar plate is aligned horizontally below the web-forming means to balance the pressure of the transport air from the fiber processing means and vertical chute means with the pressure in an air capture means, to maintain a small positive downward pressure upon the web-forming means.

14. The apparatus of claim 8 wherein a pair of idler rollers are located adjacent and external of the opposing sidewalls of the chute means and above the web-forming means which function to maintain and regulate transport air leakage from and outside ambient air into the forming apparatus.

15. The apparatus of claim 8 wherein the dimensional distance between the rotor means and the screen means is adjustable for controlling the uniformity of distribution of the individual fibers through said screen means as a function of individual fiber size and thickness of the layer of individual fibers.

* * * * *